United States Patent [19]

Làlonde

[11] Patent Number: 4,669,754

[45] Date of Patent: Jun. 2, 1987

[54] AGENDA SYSTEM

[76] Inventor: Gilles Làlonde, 27 Lanctot St., Hull, Quebec, Canada

[21] Appl. No.: 753,968

[22] Filed: Jul. 11, 1985

[51] Int. Cl.[4] ..... B42F 21/02; B42D 1/10

[52] U.S. Cl. ..... 283/67; 283/36; 283/37; 283/38; 283/42

[58] Field of Search ..... 283/36–42, 283/67; 281/3 R, 38

[56] References Cited

U.S. PATENT DOCUMENTS

| | | | |
|---|---|---|---|
| 185,482 | 12/1876 | Bowman | 281/3 R |
| 481,670 | 8/1892 | Meyer | 283/42 |
| 3,290,059 | 12/1966 | Newman | 281/3 R |
| 3,324,823 | 6/1967 | Peters | 283/38 |
| 4,419,837 | 12/1983 | Meeker | 281/38 |

FOREIGN PATENT DOCUMENTS

| | | | |
|---|---|---|---|
| 490820 | 9/1976 | Australia | 156/247 |
| 346339 | 1/1905 | France | 283/38 |
| 1017133 | 12/1952 | France | 283/42 |
| 184306 | 8/1922 | United Kingdom | 283/42 |

*Primary Examiner*—Howard N. Goldberg
*Assistant Examiner*—Taylor J. Ross
*Attorney, Agent, or Firm*—Sherman and Shalloway

[57] ABSTRACT

A novel agenda system unrestricted by a specified year is provided herein. It includes a cover and a plurality of index-tabbed sections assembled in a book-like form within the cover. The sections include a primary divider index sheet section, each sheet of which is of a selected first wide width, and all tabs of the divider sheet section are visible when the front cover is opened. The sections also include a secondary index section, each sheet of which is narrower than the sheets of the primary divider index. Such secondary section comprises a twelve-index-sheet combination (for months) and a thirty-one-index sheet combination (for days). Selected sheets from the primary divider index sheet section, i.e. a "THIS MONTH" sheet, a "NEXT MONTH" sheet, and a "TODAY" sheet are selectively insertable at particularly specified locations within the secondary section. A plurality of selectively-movable, blank and/or pre-printed inscribable sheets are provided, each sheet being smaller in size than the base sheet. These sheets are preferably provided with a coating of an adhesive over a restricted area thereof, the adhesive allowing the sheet to be affixed to, and removed from, the base sheet a plurality of times. The base sheet may be one selected sheet from the thirty-one-index sheet combination of the secondary section, or it may be a blank sheet from an optional tertiary section.

9 Claims, 18 Drawing Figures

AGENDA SYSTEM

BACKGROUND OF THE INVENTION (i) Field of the Invention

This invention relates to an agenda system variously known heretofore as a calendar or diary.

(ii) Description of the Prior Art

Such calendars or diaries generally comprise a book having a marginal index number corresponding to the days of the month. The pages under each number of the index are divided into twelve sections, bearing the designation of the successive months and also the day of the week corresponding to the day of the month represented by the index, e.g. as taught in U.S. Pat. No. 1,368,672, patented Feb. 15, 1921 by G. Wilkinson. A salient feature of such diaries was that entires when made were permanently inscribed in the diary and could not conveniently be transferred to another location.

Attempts have been made to minimize the re-scribing of entries in a diary or other permanent record or chart. For example, Dazey in U.S. Pat. No. 3,115,351 patented Dec. 24, 1963, provided a solicitation kit for fund raising drives. The Dazey invention provided a multisheet individual contributor's pad where carbonized paper was employed and in which a single printing of the individual contributor's name provided various sheets that could be used on the material that would provide a record of the worker's name contacting the contributor, and would further provide a record of the periodic intended contribution of the contributor, as well as a receipt form.

Strom, in U.S. Pat. No. 4,000,915, patented Jan. 4, 1977, provided a consumer diary. The Strom invention provided a diary and reporting device which had a folder with top and bottom covers hinged together. When opened flat, an information entry sheet composed of a general data section or zone and an item data zone was exposed. The item data zone was keyed or indexed to data entry guide book pages for instructions as to what data to enter for each type of item reported. An entry index facilitated use of the guide book. All components of the folder were removable and/or replaceable, as by means of tabs or edges on each item engaging cooperating slots or pockets in the folder cover, to facilitate regular reporting and periodic changes in the survey information to be gathered.

Lockhart, in U.S. Pat. No. 4,159,129, patented June 26, 1979, provided a pharmaceutical record and label system. In one embodiment of the Lockhard invention, a backing sheet capable of storing information relative to pharmaceutical perscriptions had a first series of adhesively-backed pharmaceutical prescription label segments removably secured thereto, each label segment having formatted zones thereon for facilitating entry of typed information and accommodating simultaneous transfer of typewriter impressions to the backing sheet. A second series of supplemental data segments on the backing sheet provide for recording of supplementary information with respect of each label segment contemporaneously with the typing of the label segment. After removal of a prescription label segment from the backing sheet, the backing sheet had stored thereon both the formatted information as entered on the label segment, and necessary supplemental data so as to facilitate computerized pharmaceeutical accounting.

Pendergrass, in U.S. Pat. No. 4,400,017 patented Aug. 23, 1983, provided an integrated budget and check record book. In the patented register for recording budget items and check items, the register had a first plurality of sheets for recording budget items and a second plurality of sheets for recording check items wherein at least a portion of the second plurality of sheets was also reserved for recording a budget category. The first and second plurality of sheets were secured for movement about a central axis in book-like fashion and were independently movable with respect to each other for permitting alignment of longitudinal lines contained on the first plurality of sheets with longitudinal lines contained on the second plurality of sheets.

Martin, in U.S. Pat. No. 4,489,958, patented Dec. 25, 1984, provided a personal time management instrument. In the patented instrument, a sheet for personal time management was provided with an activity section and a calendar section to provide an entire week's scheduled activities over the same working hours each day. A plurality of such sheets could be incorporated into a book so as to provide a permanent record on a day-to-day basis of what was planned to be done and what had been done. The activity section had a wide vertical column with horizontal lines to define spaces in which an activity may be written. The calendar section had vertical subcolumns, one of which designated each day in the time period, while the other contained blocks which were subdivided to designate sequential times in a day.

Other proposed solutions to this problem have been suggested in the form of auxiliary sheets which could be adhesively secured to various areas of preprinted sheets. For example, Osborne, in U.S. Pat. No. 1,979,283, patented Nov. 6, 1934, provided an accounting system. In the Osborne system, a chart was divided into numbered rows, or columns, and coupons were furnished which were adapted to be secured to the chart with the coupons arranged in rows at right angles to the numbered rows, the various coupons in any row overlapping shingle-wise, so that each attached coupon became associated with a certain specific numbered row or column. Thus, if the first-mentioned rows or columns were numbered from unity consecutively, the number at the head of the last column in which a coupon was attached indicated the number of coupon row. Each coupon was formed with dried adhesive on a portion of the back thereof adjacent one end for a region corresponding to the width of a numbered column. The matter it represented, was printed or written on the face of the coupon. Near the opposite end from the gummed region, the rate or other numeral on which the computation was to be based was printed on the face. When such coupons were secured to the chart, in a horizontal row, for instance, the coupons of the same rate being arranged in the same row, and overlapping each other so that each successive coupon was attached in a succeeding vertical column, then the total amount for any particular row of coupons would be the product of the rate on the coupon times the number at the head of the column to which the last coupon was attached.

Johnson, in U.S. Pat. No. 4,116,470, patented Sept. 26, 1978, provided a medical information form for a plurality of individual reports. The patented form included a base or carrier sheet which was selectively coated with pressure sensitive adhesive which was concealed by a protective removable release sheet. The release sheet was subdivided into a plurality of interconnected, independently-removable panels, each of which concealed an area of the base or carrier sheet and a portion of the adhesive pattern which was to be occupied by a single report.

Another and significantly different attempted solution to the problem was provided by Townsend, in U.S. Pat. No. 1,070,084, patented Aug. 12, 1912, as a so-called procrastenator's calendar. In that invention, a calendar was provided which included separate extra memorandum pads in connection with the calendar which were independent of the divisions of time insofar as the memoranda on the pads may remain in sight regardless of the disposal made of the sheets of the main calendar pad as time elapsed. Hence, it was said to be possible to keep the memoranda in sight until the different matters referred to therein were attended to, regardless of the lapse of time.

SUMMARY OF THE INVENTION (i) Aims of the Invention

Nevertheless all these proposed solutions did not solve the problem of avoiding making repetitive entries in a diary or calendar.

(ii) Statement of Invention

This invention therefore provides a universal agenda system unrestricted by a specified year. Such universal agenda system includes a pair of covers, i.e. a front cover and a back cover; and a plurality of sections between the covers. Such sections include a primary divider sheet section comprising a plurality of primary divider index sheets assembled in book-like form between the covers, each primary divider sheet being of a selected first width and being provided with a projecting primary marginal index tab bearing primary indicia on the front face thereof, all tabs of this divider sheet section being visible when the front cover is opened. The sections include a secondary section disposed in operative association with the primary divider index sheet section, the secondary section comprising a plurality of sheets, each sheet being provided with a projecting secondlary marginal index tab, each tab bearing an indicia on the front face thereof, the width of each sheet including its projecting secondary marginal index tab being of a width equal to, or less than, the width of a primary divider sheet without its projecting primary marginal index tab. The secondary section includes (i): a twelve-index-sheet combination, each sheet of that combination being provided with a projecting marginal index tab bearing an indicia indicative of one of the twelve months of the year, in descending sequence on the front face thereof. It also includes (ii): a selected primary divider index sheet provided with a projecting primary marginal index tab bearing the indicia "THIS MONTH" on the front face thereof, for selective insertion immediately before the index sheet designating the present month. It also includes (iii): a selected primary divider index sheet provided with a projecting primary index tab bearing the indicia "NEXT MONTH" on the front face thereof for selective insertion immediately before the index sheet designating the next month. It also includes (iv): a thirty-one-index-sheet combination selectively insertable between the "THIS MONTH" primary divider index sheet and the "NEXT MONTH" primary divider index sheet, each sheet of the thirty-one-index-sheet combination being provided with a projecting marginal index tab bearing an indicia indicative of one of a possible maximum of thirty-one days of a month in descending sequence, on the front face thereof. Finally, it also includes (v): a selected primary divider index sheet provided with a projecting primary marginal index tab bearing the indicia "TODAY" on the front face thereof, for selective insertion immediately before the index sheet designating the present day of the present month. Finally, the agenda system includes a plurality of selectively-movable, inscribable sheets, each sheet being smaller in size than each of the index sheets of the thirty-one-index-sheet combination. Each sheet of the secondary thirty-one-index-sheet combination or the selectively-movable sheet is provided with a coating of a selected adhesive over a restricted area thereof, the selected aadhesive allowing the selectively-movable sheet to be affixed to, and removed from, the sheets of the thirty-one-index-sheet combination a plurality of times. Instead of the selected sheet of the thirty-one index sheet combination being used to hold the selectively movable inscribable sheets, a blank sheet of an optional tertiary section may be used.

Additional twelve-index-sheet combinations and thirty-one-index-sheet combinations, for indicating months and days of the month, respectively, as in (i) and (ii) above, may be provided for insertion in other sections of the agenda system, such as a RECORDER section, a GOALS ACHIEVED section, and so on.

This invention also provides a method of using the above-described universal agenda system. The method comprises the first step of providing, between a front cover and a back cover, a plurality of primary divider index sheets assembled in book-like form, each primary divider sheet being of a selected first width and being provided with a projecting primary index tab bearing primary indicia on the front face thereof, all the tabs being visible when the front cover is opened. The next step is disposing a secondary section in operative association with the primary divider index sheets, the secondary section comprising a plurality of sheets, each sheet being provided with a projecting secondary marginal index tab, each tab bearing an indicia on the front face thereof, the width of each sheet including its projecting secondary marginal index tab being of a width equal to, or less than, the width of the primary divider index sheets without the projecting marginal index tab. At least one secondary section which is so disposed includes: a secondary twelve-index-sheet combination, each sheet of that combination being provided with a projecting marginal tab bearing an indicia designating one of the twelve months of the year, in descending sequence on the front face thereof, and a secondary thirty-one-index sheet combination, each sheet of the thirty-one-index-sheet combination being provided with a projecting marginal tab bearing an indicia designating one of a possible maximum of thirty-one days of a month in descending sequence, on the front face thereof. The next step comprises selectively inserting a selected primary divider index sheet provided with the projecting primary marginal index tab bearing the indicia "THIS MONTH" on the front face thereof, immediately before the index sheet designating the present month. The next step comprises selectively inserting a selected primary divider index sheet provided with a projecting primary index tab bearing the indicia "NEXT MONTH" on the front face thereof immediately before the index sheet designating the next month. The next step comprises selectively inserting the thirty-one-index-sheet combination between the "THIS MONTH" primary divider index sheet and the "NEXT MONTH" primary divider index sheet. The next step comprises selectively inserting a selected primary divider index sheet provided with a projecting primary marginal index tab bearing the indicia "TODAY" on the front face thereof, immediately before the index sheet designating the present day of the present month. The next step comprises inscribing a selected message on at least one of a plurality of selectively-movable, inscribable sheets, each sheet being smaller in size than each of the sheets of the thirty-one-index-sheet combination, and either the selected sheet of the thirty-one-index-sheet combination or the selectively-movable sheet being provided with a coating of a selected adhesive allowing the selectively-movable sheet to be affixed to, and removed from, the sheet of the thirty-one-index combination a plurality of times. The next step comprises affixing the inscribable sheet bearing the inscribed message to a first selected region of a selected sheet of the thirty-one-index-sheet combination designating the present day of the present month or to an optional tertiary sheet associated with the secondary thirty-one-index-sheet combination. The next step comprises, at a later time, removing the inscribable sheet bearing the inscribed message from the first selected region of the selected sheet of the thirty-one-index-sheet combination, or from an optional tertiary sheet associated with the secondary thirty-one-index sheet combination, and affixing the same inscribable sheet bearing the inscribed message either to the reverse face of the "TODAY" primary divider index sheet, or to a selected sheet of the thirty-one-index-sheet combination, or to an optional tertiary sheet associated with the secondary thirty-one-index sheet combination. The next steps involve moving the "THIS MONTH" and the "NEXT MONTH" primary divider index sheets monthly to satisfy the requirements of steps (C) and (D); and (K) moving the "TODAY" primary divider index sheet daily to satisfy the requirements of step (F).

(iii) Other Features of the Invention

The cover may be a loose leaf book which is adapted selectively to hold a plurality of sections, each of which includes a plurality of sheets. Alternatively, the cover may be a cylindrical prong type cover, of the type used as Accounts books. Furthermore, the cover may be of the types known by the trade marks ACCO or DUO TANG. The size of such cover is variable and can range from a wall-chart size to a letter-size or legal-size binder, to a pocket-size binder.

The plurality of sections, and the indexed sheets, may be selected to satisfy the particular needs of many individuals in many professions. They may be assembled to be especially useful in an agenda or registry system, action work book; or a diary or records system, action recorder, log book; or as a wallboard or chart-type system for use as a monthly or yearly calender, as a production chart or as a planning and achievement chart.

When used as an agenda or diary system, the various sections and indexed pages may be selected at will to include many of the following: a removable transaction or accounts payable pouch; a registry section including indexed monthly and daily sheets, namely: twelve narrow sheets respectively bearing the marginal index tabs JAN, FEB, etc. and thirty-one narrow sheets respectively bearing the marginal index tabs 1, 2, 3, etc.; with a wide "THIS MONTH" index sheet being adapted to be moved monthly to a location immediately before the index sheet designating the present month; with a wide "NEXT MONTH" index sheet being adapted to be moved monthly to a location immediately before the index sheet designating the next month; with the narrow thirty-one index sheets always being between the "THIS MONTH" and the "NEXT MONTH" index sheets; and with a wide "TODAY" index sheet adapted to be moved daily to a location within the thirty-one index sheets to such sheet designating the present day; a "RECORDER" section, or diary or log; and a name register in conjunction with alphabetic index markers. In the "THIS MONTH" section the messages, appointments or transactions for particular days of particular months, which are inscribed on the special sheets, are primarily affixed, for later movement to the "TODAY" section. The "TODAY" section may include on the left-hand sheet page, a supply of such inscribable sheets and a calendar of the year and/or month. On the right hand sheet page facing the left hand-sheet, the messages, appointments or transactions for that day, which are inscribed on the selectively-movable sheets, may be attached.

In the "RECORDER" section, the messages, appointments or transactions, which were previously in the "TODAY" section, may be placed, for remainder or for posterity. In the "name register", names and telephone numbers of business associates and/or business cards and/or names and telephone numbers of friends may be placed via the special inscribed sheets or by means of a special adhesive member, i.e. a tape or the double-faced adhesive tabs having a release sheet therein, of the type known by the trade mark KWIK MOUNT self-adhesive tabs, as manufactured for Hutchins and Patrick, Ottawa, Canada., for the business cards.

Additional sections may be included for special disciplines or professions. Non-limiting examples include:

For a salesman, a sales agenda as follows: a "completed" section, for sales or other contract which has been signed; a "pending" section, for awaiting for a prospect to sign a contract, for the purpose of a follow-up: a "later" section for possible future sales or prospects; and an "abandon" section for cancelled items.

For a home budget: a "payable" section; a "paid" section; a "receivable" section; a "received payment" section; and a "miscellaneous" or "loose-ends" section.

For a goal planner: a "life chart" section; a "brain storm" section; a "motivator" section including philosophical and/or inspirational sayings or phrases; a "goals proposed" section; a "goals achieved" section, aa diary log; a "goal activity" chart; and a "goal progress" chart.

In addition, an "auxiliary" or "recorder" book may be provided which may include a chronologically arranged and an indexed or transaction recorder section, (transferred from the "agenda" book); a "goals achieved" section (transferred from the "goal planner book) and/or a name and/or business card posted section, (transferred from the "name registry" section)

The selectively-movable inscribable sheets are preferably those sold by the trade mark POST-IT which includes a minor portion coated with a low-adhesion, pressure-sensitive adhesive so that the sheets may be affixed aand removed a plurality of times. Alternatively, an ordinary sheet or business card may be affixed by means of a double-faced tape and/or tab as described above having both surfaces coated with such adhesive. A single-faced such tape having such weak adhesive is known by the trade mark of MAGIC PLUS removable transparent tape. Still further, the base sheets may be coated with selected areas of such adhesive and then may be covered by a removable backing strip so that inscribed messages and/or appointments and/or business cards may be temporarily affixed thereto.

(iii) Essential Features of the Invention

It is important for the successful operation of the loose-leaf book embodiment of this invention that there be complete visibility of the tabs within each section. Thus, there is a critical interrelationship between the width of the primary marginal index sheets, the secondary marginal index sheets and any blank or lightly printed auxiliary or supplemental base sheets which may optionally be used in a tertiary section.

For example, the primary marginal index sheets may be 8⅞" wide, including the tab but only 8⅜" wide excluding the tab. The secondary marginal index sheets may be 8⅜" wide including the tab, and includes two essential sub-sections, namely (a) first secondary marginal index sheets (namely thirty-one index sheets representative of the thirty-one possible days of the month)

and (b) second secondary marginal index sheets (namely twelve index sheets representative of the twelve months of the year)

If auxiliary or supplemental base or blank sheets are used in an optional tertiary section, they may be 8" wide and need not include any tabs.

The two essential components may be used for affixation of adhesive-coated sheets and/or the two essential components may be preprinted with various inscriptions.

As noted above, the secondary divider sheets and the base sheets are narrower than the primary divider sheet to provide the essential visibility. Alternatively, the index sheets may use different widths of extended tabs to provide the essential visibility.

BRIEF DESCRIPTION OF THE DRAWINGS

In the accompanying drawings,

FIGS. 1–13 are views of a typical AGENDA system of one embodiment of this invention in which:

FIG. 1 shows the agenda opened at its first section;

FIG. 2 shows the agenda opened at a first intermediate section;

FIG. 3 an enlarged fragmentary view of that agenda which shows the agenda opened at its "THIS MONTH" indexed section;

FIG. 4 an enlarged fragmentary view of that agenda which shows the agenda opened at its selected "THIS MONTH" section;

FIG. 5 an enlarged fragmentary view of that agenda which shows the agenda opened at a second intermediate section;

FIG. 6 an enlarged fragmentary view of that agenda which shows the agenda opened at its "TODAY" indexed section;

FIG. 7 an enlarged fragmentary view of that agenda which shows the agenda opened at its selected "TODAY" section;

FIG. 8 an enlarged fragmentary view of that agenda which shows the agenda opened at its "NEXT MONTH indexed section;

FIG. 9 an enlarged fragmentary view of that agenda which shows the agenda opened at its selected "NEXT MONTH" section;

FIG. 10 an enlarged fragmentary view of that agenda which shows the agenda opened at its "RECORDER" indexed section;

FIG. 11 an enlarged fragmentary view of that agenda which shows the agenda opened at its "NAME ROSTER" indexed section;

FIG. 12 shows an enlarged fragmentary view of that agenda opened at the first page of its alphabetic index section for the "NAME ROSTER" section; and FIG. 13 shows that agenda opened at its "REMOVABLE TRANSACTION POUCH" and FIGS. 14–18 are views of a typical RECORDER system of an additional embodiment of this invention, in which FIG. 14 shows an enlarged fragmentary view of the recorder opened at its first section showing the "RECORDER 1985" index tab;

FIG. 15 shows an enlarged fragmentary view of that recorder opened at the "JAN" indexed tab section of the twelve month indexed tab "RECORDER" section;

FIG. 16 shows that recorder opened at its "GOALS ACHIEVED" indexed section;

FIG. 17 shows an enlarged fragmentary view of that recorder opened at its "NAME ROSTER"; and FIG. 18 shows an enlarged fragmentary view of that recorder opened at the first page of it alphabetic index section from the "NAME ROSTER" section

DESCRIPTION OF PREFERRED EMBODIMENTS (i) Description of FIGS. 1–13

Figure 1:
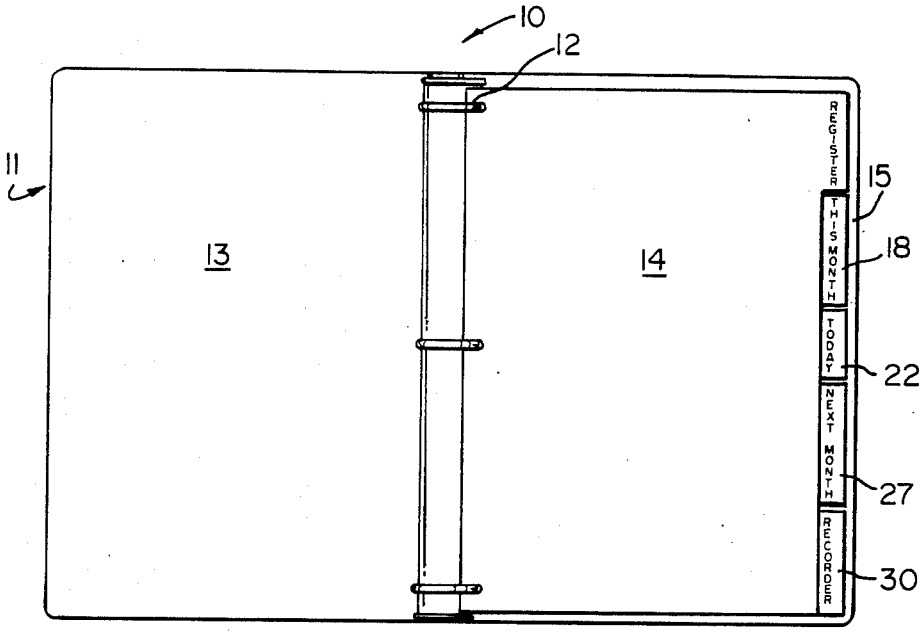

Dealing firstly with FIGS. 1–13, as seen in FIG. 1, the AGENDA system 10 includes a loose leaf binder 11 with various sections, each consisting of a plurality of sheets inserted therein on rings 12. FIG. 1 shows the front inside cover 13 of the binder 11, the top wide primary divider index sheet 14 "(REGISTRY)" of the registry section and the rear inside cover 15 of the binder 11. Some of the following wide primary divider index sheets, i.e. "THIS MONTH" (18); "TODAY" (22); "NEXT MONTH" (27): and "RECORDER" (30) are also visible on rear inside cover 15.

Figure 2:
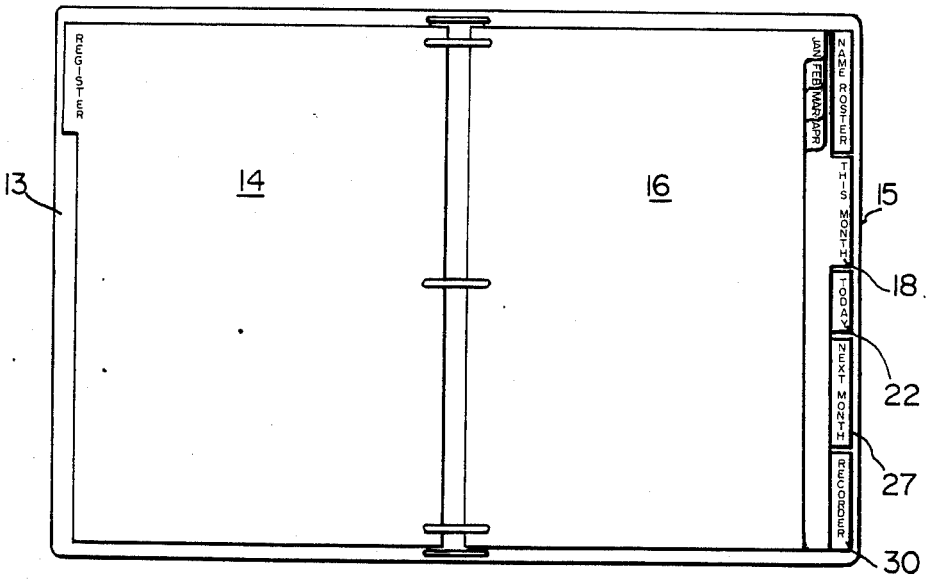

FIG. 2 shows the full rear (left hand) face of the "REGISTRY" wide primary divider index sheet 14, the "JAN" secondary index sheet 16 being completely visible, The index tabs only of some of the subsequent narrow, secondary index sheet combination, i.e. FEB, MARCH and APRIL are also visible on rear inside cover 15 It is also noted that the blank sheets of this section have been omitted for clarity.

Figure 3:
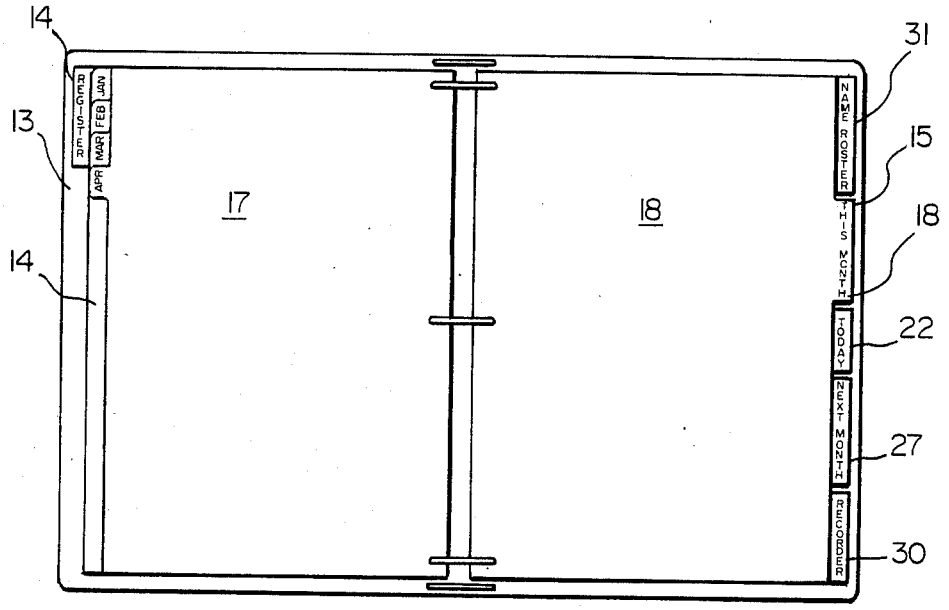

FIG. 3 shows the full rear (left-hand) face of the "passed" of the APRIL secondary index sheet 17 the index tabs only of the previous months, namely JAN, FEB and MARCH also being visible on the front inside cover 13. It is also noted that the rear face of the index tab of the "passed" primary divider index sheet "REGISTRY" (14) is also visible on the front inside cover 13. The full front face of the "THIS MONTH". wide primary divider sheet 18.

Figure 4:
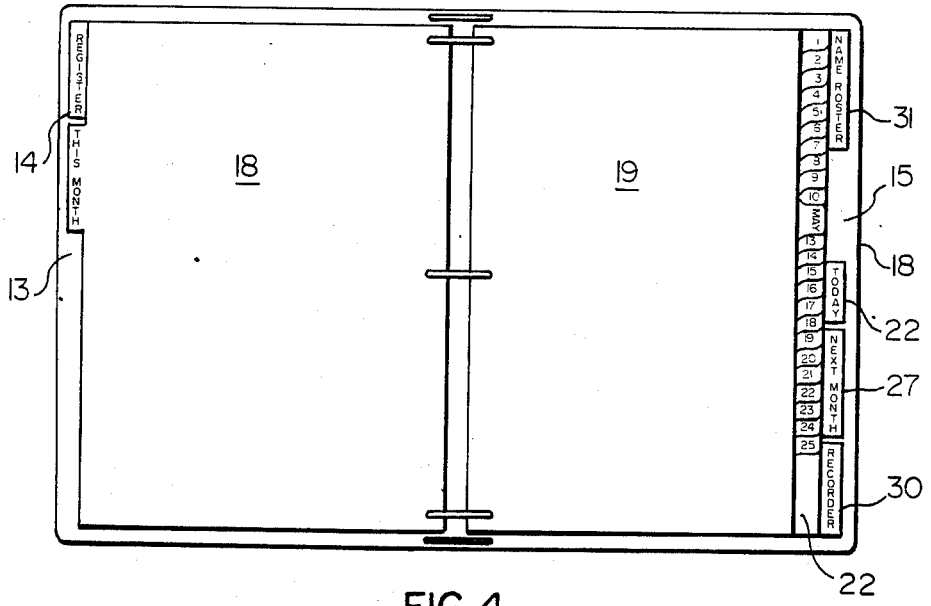

FIG. 4 shows the full rear (left-hand) face of the "THIS MONTH" wide, primary divider sheet 18. It is also seen that the rear face of the "passed" primary divider index sheet "REGISTRY" (14) is also visible over the front inside cover 13. The full front face of the selected present month secondary index sheet, i.e. the "MAY" secondary index sheet 19. It will be seen that the tabs only of the following primary divider index sheets, i.e. TODAY (22), "NEXT MONTH" (27) and "RECORDER" (30) are also visible on the rear inside cover 15. It will be seen that the tabs only of the following primary divider index sheets, i.e. TODAY (22), "NEXT MONTH" (27) and "RECORDER" (30) are also visible on the rear inside cover 15.

Figure 5:
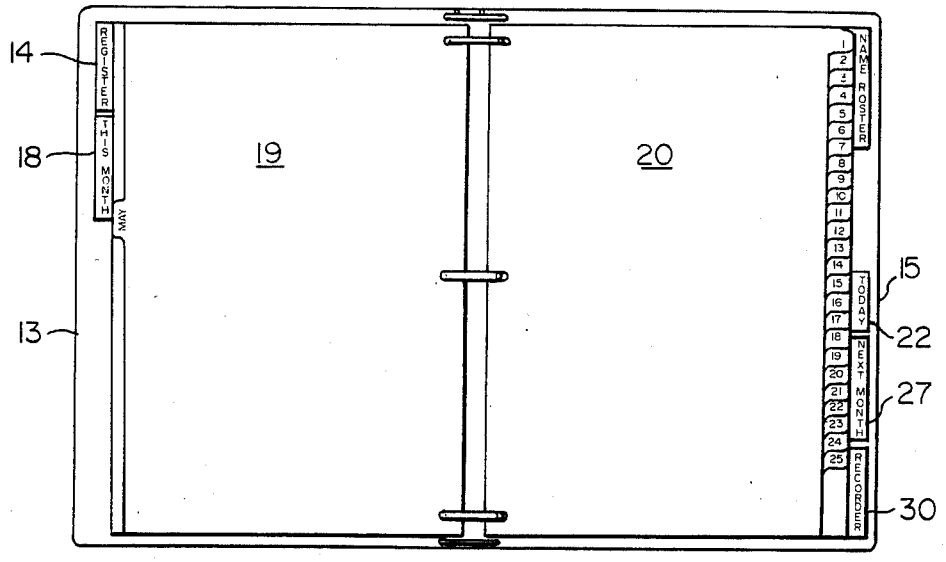

FIG. 5 shows the full rear (left-hand) face of the selected secondary index sheet, i.e. the MAY secondary index sheet 19. It will be noted that the index tabs of the "passed" primary divider index sheets i.e. "REGISTER" (14) and "THIS MONTH" (18) are also visible on front inside cover 13. On the other hand, it will be noticed that, since the primary divider index sheets, i.e. the "THIS MONTH" sheet (18) and the "REGISTER" sheet (14) are wider than the twelve secondary index sheets, such "month" sheets designating the months gone by, i.e. those prior to May are not visible. It is also noted that the full front face of the secondary index sheet 20 designating day "1" is completely visible. It is also noted that the index tabs only of future days of the thirty-one secondary index sheets, i.e. days 2–31 are also visible on rear inside cover 15. Moreover it is also noted that the index tabs only of "future" primary divider index sheets i.e. "NEXT MONTH" (27) and "RECORDER" (30) are also visible on rear inside cover 15. It is also noted that the blank sheets of this section have been omitted for clarity.

Figure 6:
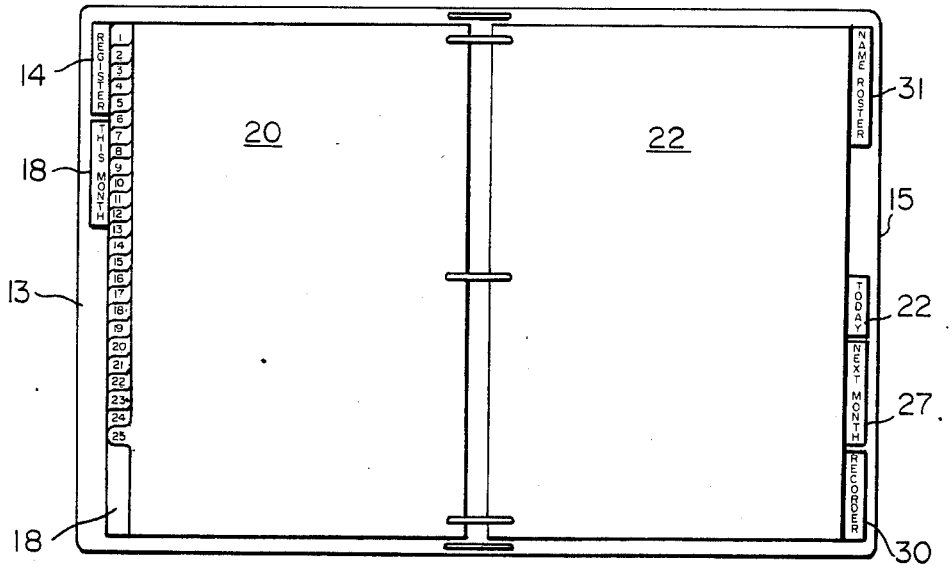
Figure 7:
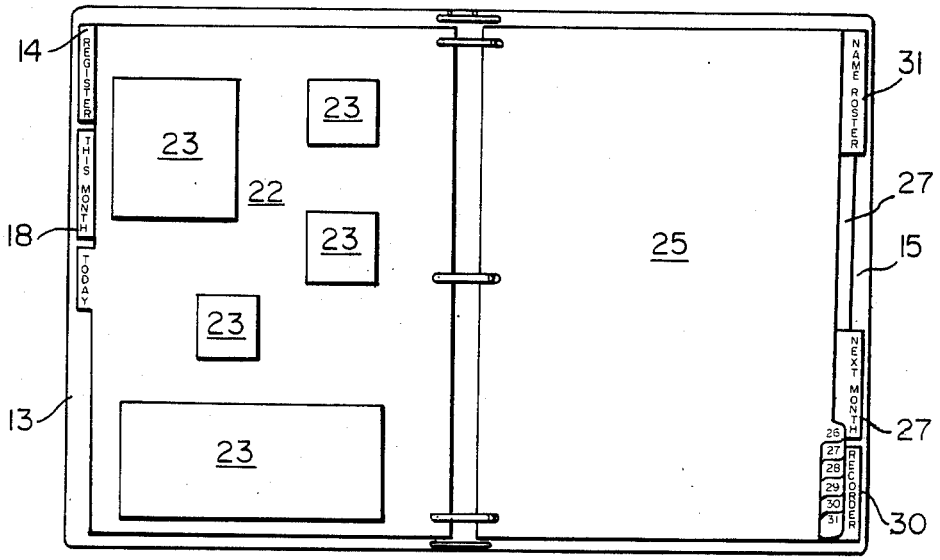

FIG. 6 shows the rear (left-hand) face of the secondary index sheet representative of the last day which has gone by, i.e. day 25, and the index tabs only representative of the other days which have gone by, i.e. days 1–24. The rear face of the index tabs of the "passed" primary divider index sheets, i.e. "REGISTER" (14) and "THIS MONTH" (18), are also visible on front inside cover 13. The front face of the selected primary divider sheet, i.e. the "TODAY" sheet (22) is also completely visible on rear inside cover 15. In addition, the front face of the index tabs of the "future" primary divider index sheets, i.e. "NEXT MONTH" (27) and "RECORDER" (30) are also visible on rear inside cover 15, since the blank sheets of this section have been omitted for clarity. The FIG. 7 shows the "TODAY" section. This is constituted by the full rear face of the "TODAY" primary divider sheet 22, bearing a plurality of differently sized, special sheets 23, preferably those known by the trade mark POST-IT. It also shows the full secondary index sheet 25 designating the present day, namely day 26. The index tabs only of the secondlary index sheets designating the future days (namely the index tabs only of the secondary index sheets designating days 27–31). It will also be noted the front face of the index tabs of the "future" primary divider index sheets, i.e. "NEXT MONTH" (27) and "RECORDER" (30) are also visible on rear inside cover 15.

Figure 8:
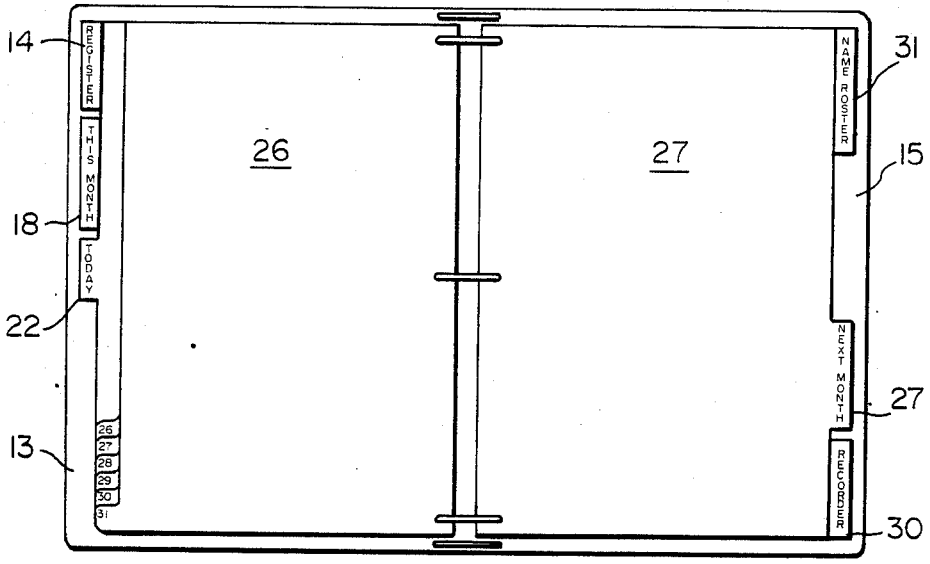

FIG. 8 shows the full rear (left-hand) face of the secondary index sheet 26 designating the sheet for the thirty-first day of the month, i.e. day "31", while the index tabs only of the secondary index sheets designating the immediate next day "26" and the following future days, i.e. days 27–31 are also visible on rear inside cover 15. It is also noted that the rear face of the index tabs of the "passed" primary divider sheets, i.e. "REGISTER" (14), "THIS MONTH" (18) and "TODAY" (22) are visible on front inside cover 13. It is also noted that the blank sheets of this section have been omitted for clarity. It also shows the full front face of the "NEXT MONTH" primary divider index sheet 27. It also shows the front face of the index tab of the "future" index sheet "RECORDER" (30) on the rear inside cover 15, sheet 27.

Figure 9:
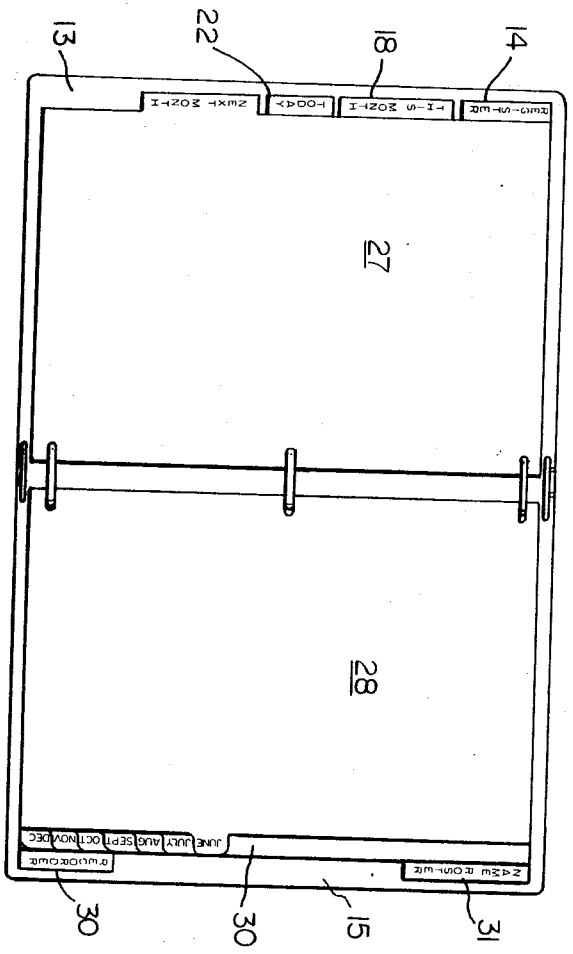

FIG. 9 shows the full rear (left-hand) face of the "NEXT MONTH" primary divider sheet 27, as well as the full secondary index sheet 28 designating the next month, i.e. June, and the tabs only of the secondary index sheets designating the future months July–Dec. It is also noted that the rear faces of the index tabs of the "passed" primary divider index sheets "REGISTER" (14), "THIS MONTH" (18) and "TODAY" (22) are also seen on front inside cover 13. In addition, the front face of the index tab of the "future" primary divider index sheet, i.e. "RECORDER" (30) is seen on rear inside cover 15, on the right hand side. It is also noted that the blank sheets of this section have been omitted for clarity.

Figure 10:
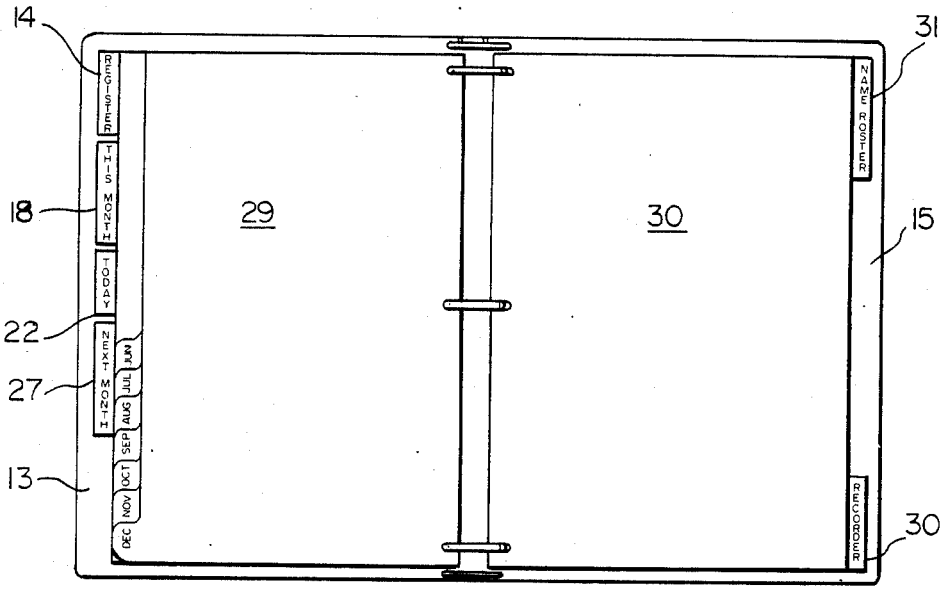

FIG. 10 shows the full rear (left-hand) face of the secondary index sheet 29 designating the last of the future months, i.e. DEC, while the rear face of the index tabs designating the earlier future months, i.e. JUNE–NOV. are seen on front inside cover 13. It is also seen that the rear face of the "passed" primary divider index sheets, i.e. "REGISTER" (14), "THIS MONTH" (18), "TODAY" (22) and "NEXT MONTH" (27) are also seen on front inside cover 13. It is noted that the blank sheets of this section have been omitted for clarity. It also shows the front face of the "RECORDER" primary divider sheet 30, as well as the index tab of the primary divider sheet 32 designating the "NAME ROSTER".

Figure 11:
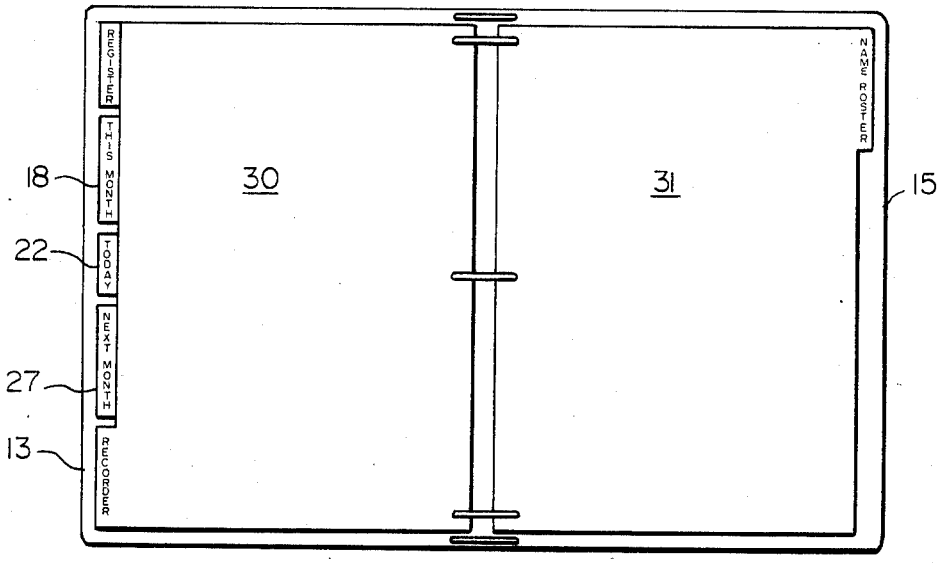

FIG. 11 shows the full rear (left-hand) face of the "RECORDER" primary divider sheet 30, the other pages of the "RECORDER" section being omitted for clarity. It also shows the front face of the "NAME ROSTER" primary divider index sheet 31.

Figure 12:
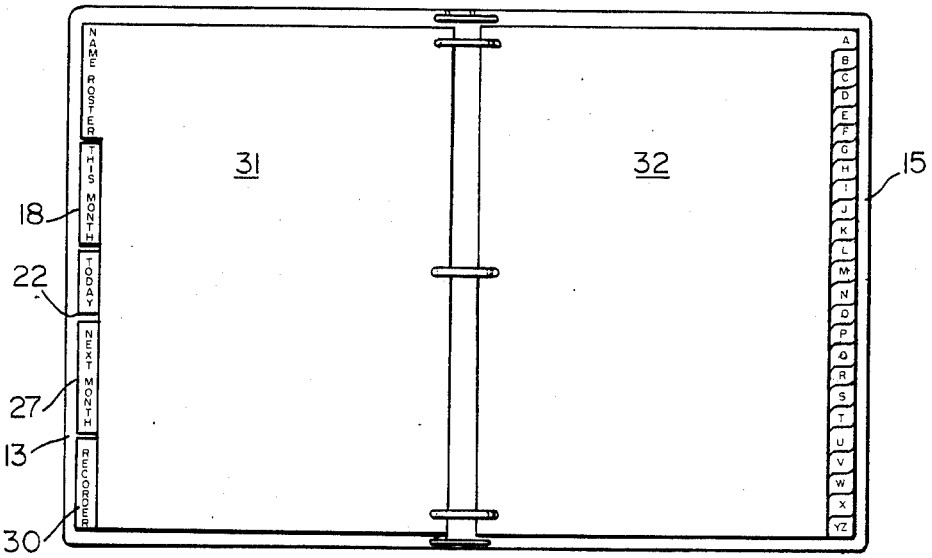

FIG. 12 shows the full rear (left-hand) face of the secondary index sheet designating "NAME ROSTER" primary divider index sheet 31 as well as the first index sheet "32" of the alphabetic section of the name namely the index sheet representative of the letter "A", the index tabs only of the sheets representative of the letters B–Z are also seen on rear inside cover 15.

Figure 13:
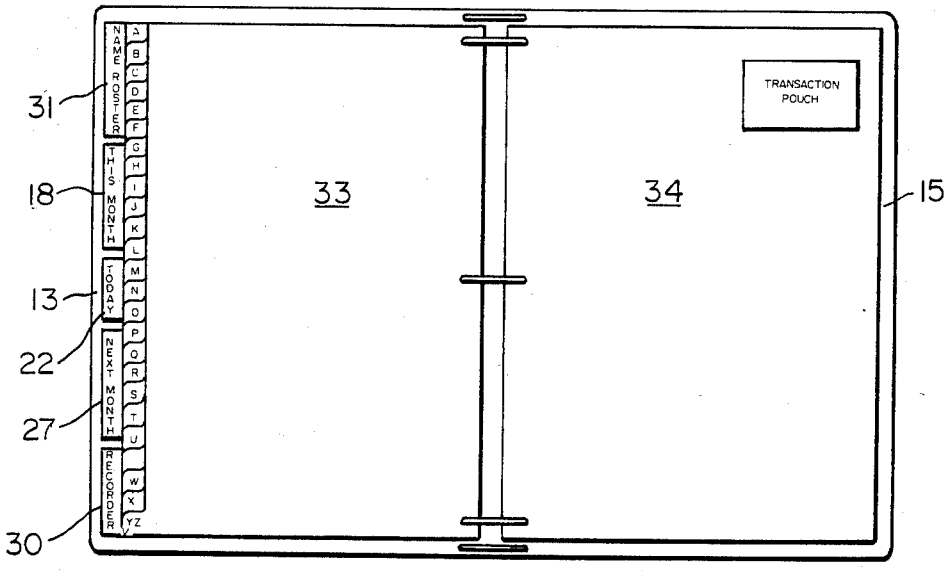

FIG. 13 shows the full rear (left-hand) face of the last sheet of the "NAME ROSTER" and the index tabs only of the previous sheets of the NAME ROSTER section, i.e. tabs for the sheets representative of the letters "A–X" are also seen on inside cover 15. In other words, the last "XYZ" indexed sheet 33 is shown completely, the pages of the "XYZ" section of the "NAME ROSTER" section being omitted for clarity. It also shows the front cover of the "REMOVABLE TRANSACTION POUCH" 34. The transaction pouch 34 may contain loose papers of deeds that need to be done. It may be placed at the appropriate day and month section, or at the front or at the rear of the AGENDA. The front inside cover 13 and rear inside cover 15 are also seen. In addition the rear faces of the tabs of the primary divider index sheets "RECORDER" (30), "NEXT MONTH" (27), "TODAY" (22), "THIS MONTH" (18) and "REGISTER" (14) are also seen on front inside cover 13.

(ii) Description of FIGS. 14–18

FIGS. 14–18 show another form of an agenda system of this invention used as a RECORDER.

Figure 14:
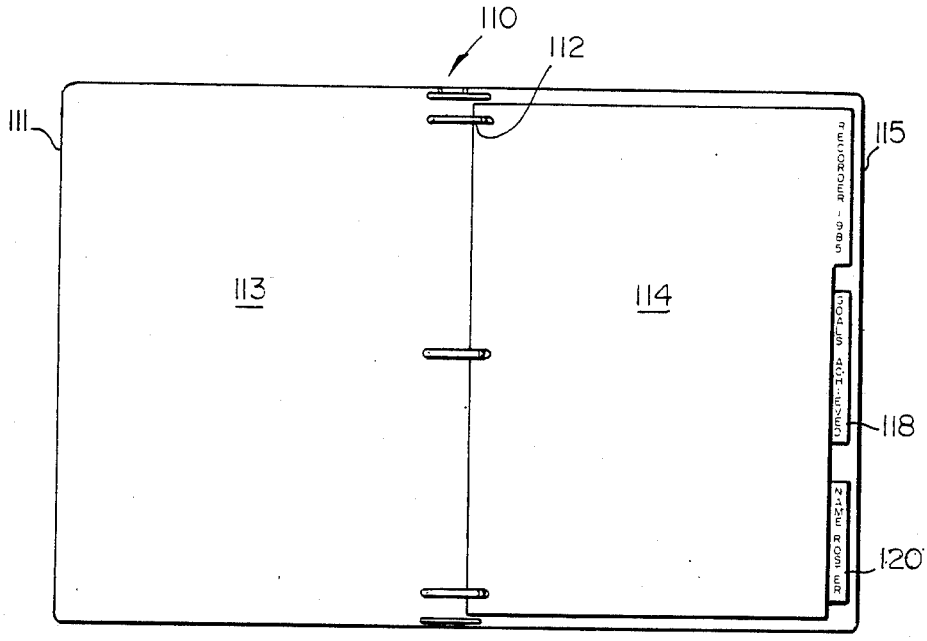

Now referring to FIGS. 14–18, as seen in FIG. 14 the "RECORDER" 110 includes a loose leaf binder 111 with various sections, each consisting of plurality of sheets inserted therein in rings 112. FIG. 14 shows the front inside cover 113 of the binder 111, the full front face of the top primary divider sheet 114 bearing the marginal index tab RECORDER 1985 of the recorder, and the rear inside cover 115 of the binder 111. The tabs of further primary divider sheets bearing the index tabs "GOALS ACHIEVED" (118), and "NAME ROSTER" (120) are also seen on inside rear cover 115.

Figure 15:
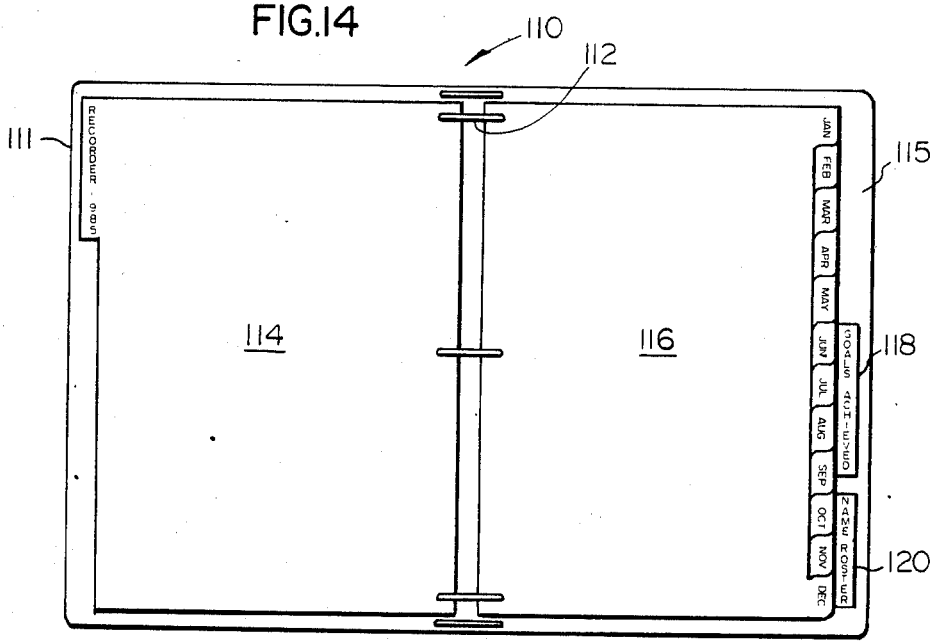

FIG. 15 shows the full rear (left-hand) face of the "RECORDER 1985" primary divider index sheet 114 as well as the full front face of the first secondary index sheet 116 of the twelve index sheets (JAN–DEC) of this section, i.e. the secondary index sheet representative of JAN. The index tabs only of the secondary sheets bearing the marginal index tabs FEB–DEC are also seen on inside rear cover 115. The tabs only of further primary divider sheets designating "GOALS ACHIEVED" (118) and "NAME ROSTER" (120) are also seen on rear inside cover 115.

Figure 16:
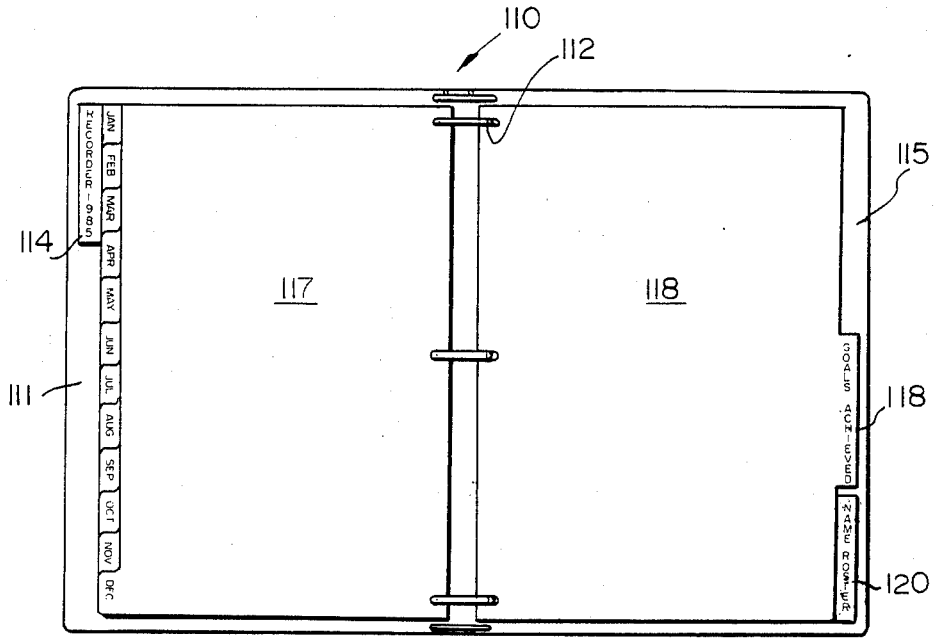

FIG. 16 shows the full rear (left-hand) face of the last sheet 117, i.e. the DEC sheet, of the twelve secondary index sheets designating the months JAN–DEC. While the index tabs only of the secondary index sheets representative of the previous months of JAN–NOV are seen on inside front cover 113. The complete rear face of the Dec section, 117 is shown, the pages of that section being omitted for clarity. It also shows the full front face of the primary divider index sheet 118 designating "GOALS ACHIEVED" and the index tab only of the primary divider sheet 120 designating "NAME ROSTER" is also seen on front inside cover 115.

Within the "GOALS ACHIEVED" section are sheets which are adapted to show the progress towards goals. These are not shown in detail since there are many examples of pre-printed pages, but could include a "goal activity chart" and a "goal progress" chart.

Figure 17:
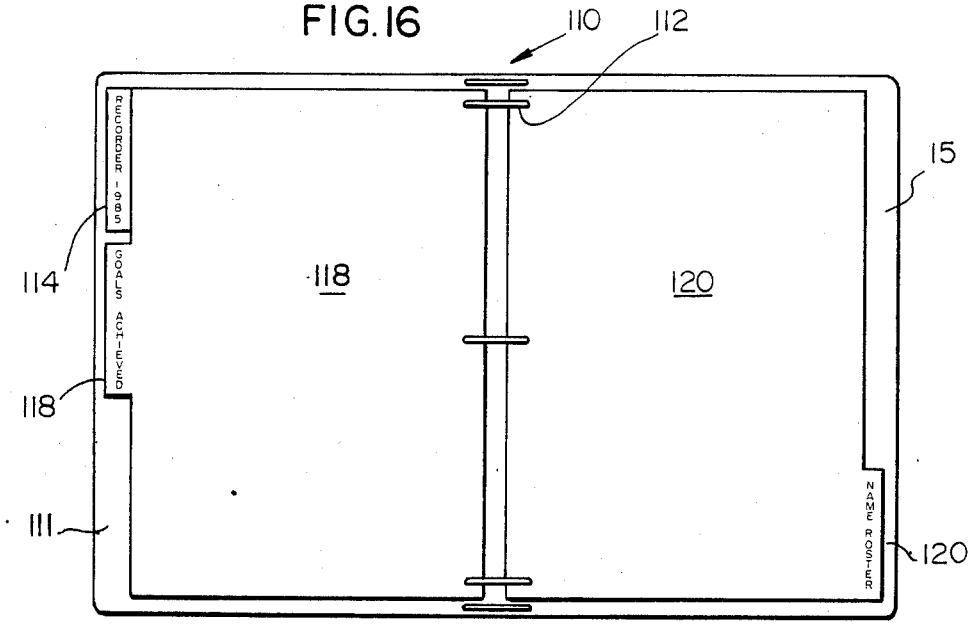

FIG. 17 shows the full rear (left-hand) face of one of the sheets 119 within the "GOALS ACHIEVED" section on inside front cover 113. It also shows the index tabs of the previous primary divider index sheets bearing the index tabs "GOALS ACHIEVED" (118) and "RECORDER 1985" (114) on the inside front cover 113, as well as the front face of the primary divider index sheet 120 designating "NAME ROSTER".

Figure 18:
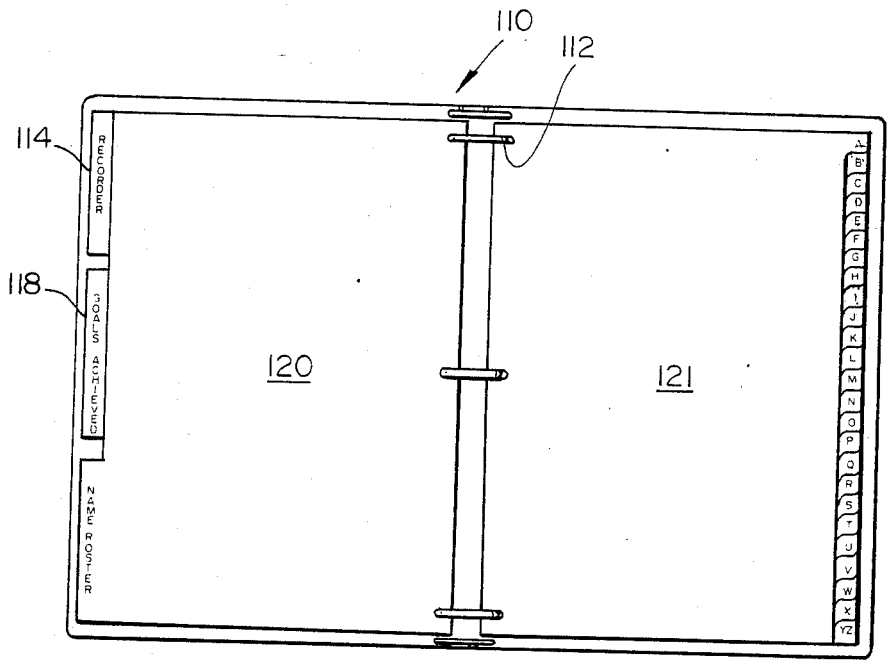

FIG. 18 shows the full rear (left-hand) face of the primary divider index sheet 120 designating "NAME REGISTER" as well as the full front face of the first secondary index sheet 121 designating the letter A of the "NAME REGISTER" alphabetic section. The index tabs only of the secondary sheets designating the alphabet "B–Z" are also seen on rear inside cover 115.

OPERATION OF PREFERRED EMBODIMENTS

In use, as appointments, meetings, schedules, etc, are made or developed, they are inscribed for the one and only time on the POST-IT sheet, and placed in the proper time slot, i.e. the month and day. Each month, the "THIS MONTH" indexed sheet 16 is moved to the current month, e.g. MAY. Each day, the "TODAY" index 17 is moved to the proper day of the month, e.g. 26, and any appointments, meetings, etc. for that day are automatically seen on the right hand sheet.

Once the appointments, meetings, etc. are completed, the sheet bearing the inscribed message for such appointments, meetings, etc. is placed in the appropriate section, i.e. the month and day of the "RECORDER" section. On the other hand, if appointment, meeting, etc is rescheduled, the sheet bearing the inscribed message is placed in the appropriate "NEXT MONTH" section, to be met automatically as the "TODAY" indexed sheet is inserted therein.

The "NAME ROSTER" section is used for the alphabetic placement of names, addresses and telephone numbers which are inscribed on the POST-IT sheets and placed at the appropriate alphabetic indexed section. This section may also be used for the placement of business cards, using an adhesive system, e.g. the KWIK-MOUNT system previously described, at the appropriate alphabetic indexed section.

SUMMARY

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalent of the following claims.

I claim:

1. A method of using a universal agenda system unrestricted by a specified year, comprising the steps of:

A. providing, between a front cover and a rear cover, a plurality of primary divider index sheets assembled in book-like form therebetween, each said primary divider index sheet being of a selected first width and being provided with a projecting primary index tab bearing primary indicia on the front face thereof, all said tabs being visible when said front cover is opened;

B. disposing a secondary section in operative association with said primary divider index sheets, said secondary section comprising a plurality of sheets, each said sheet being provided with a projecting secondary marginal index tab, each said tab bearing an indicia on the front face thereof, the width of each said sheet including its said projecting secondary marginal index tab being of a width equal to, or less than, the width of said primary divider sheets without its said projecting primary marginal index tab, said secondary section comprising a twelve-index-sheet combination, each sheet of said combination being provided with a projecting marginal tab bearing an indicia designating one of the twelve months of the year, in descending sequence on the front face thereof, and a thirty-one-index sheet combination, each said sheet each said sheet of said thirty-one-index-sheet combination being provided with a projecting marginal tab bearing an indicia designating one of a possible maximum of thirty-one days of a month in descending sequence, on the front face thereof;

C. selectively inserting a selected primary divider index sheet provided with a projecting primary marginal index tab bearing the indicia "THIS MONTH" on the front face thereof, immediately before the secondary index sheet designating the present month;

D. selectively inserting a selected primary divider index sheet provided with a projecting primary index tab bearing the indicia NEXT MONTH" on the front face thereof immediately before the secondary index sheet designating the next month;

E. selectively inserting said thirty-one-index-sheet combination between said "THIS MONTH" primary divider index sheet and said "NEXT MONTH" primary divider index sheet;

F. selectively inserting a selected primary divider index sheet provided with a projecting primary marginal index tab bearing the indicia "TODAY" on the front face thereof, immediately before the index sheet designating the present day of the present month;

G. inscribing a selected message on at least one of a plurality of selectively-movable, inscribable sheets, each sheet being smaller in size than each of said sheets of said thirty-one-index-sheet combination, and either said sheet of said thirty-one-index-sheet combination or said selectively-movable sheet being provided with a coating of a selected adhesive allowing said selectively-movable sheet to be affixed to, and removed from, said sheet of said thirty-one-index combination a plurality of times;

H. affixing said inscribable sheet bearing said inscribed message to a first selected region of a selected sheet of said thirty-one-index-sheet combination representative of the present day of the present month;

I. at a later time, removing said inscribable sheet bearing said inscribed message from said first selected region of said selected sheet of said thirty-one-index-sheet combination, and affixing said same inscribable sheet bearing said inscribed message either to the reverse face of said "TODAY" index sheet, or to a selected sheet of said thirty-one-index-sheet combination;

J. moving said "THIS MONTH" and said "NEXT MONTH" primary divider index sheets monthly to satisfy the requirements of steps (E) and (D);

and

K. moving said "TODAY" primary divider index sheet daily to satisfy the requirements of step (F).

2. A universal agenda system unrestricted by a specified year, comprising in combination:

a. a front cover and a rear cover;

b. a plurality of primary divider index sheets assembled in book-like form between said covers, each primary divider index sheet being of a selected first width and being provided with a projecting primary marginal index tab bearing primary indicia on the front face thereof, all said tabs being visible when said front cover is opened;

c. a secondary section disposed in operative association with said primary divider sheets, said secondary section comprising a plurality of sheets, each said sheet being provided with a projecting secondary marginal index tab, each said tab bearing an indicia on the front face thereof, the width of each said sheet including its said projecting secondary marginal index tab being of a width equal to, or less than, the width of said primary divider sheets without its said projecting primary marginal index tab, said secondary section comprising:

i. a twelve-index-sheet combination, each sheet of said combination being provided with a projecting marginal tab bearing an indicia designating one of the twelve months of the year, in descending sequence on the front face thereof;

ii. a selected primary divider index sheet provided with the projecting primary marginal index tab bearing the indicia "THIS MONTH" on the front face thereof, for selective insertion immediately before the secondary index sheet designating the present month;

iii. a selected primary divider index sheet provided with a projecting primary index tab bearing the indicia "NEXT MONTH" on the front face thereof for selective insertion immediately before the index sheet designating the next month;

iv. a thirty-one-index-sheet combination selectively insertable between said "THIS MONTH" primary divider index sheet and said "NEXT MONTH" primary divider index sheet, each said sheet of said thirty-one-index-sheet combination being provided with a projecting marginal tab bearing an indicia designating one of a possible maximum of thirty-one days of a month in descending sequence, on the front face thereof;

and v. a selected primary divider sheet provided with a projecting primary marginal index tab bearing the indicia "TODAY" on the front face thereof, for selective insertion immediately before the index sheet designating the present day of the present month;

and d. a plurality of selectively-movable, inscribable sheets, each said sheet being smaller in size than each of said sheets of said thirty-one-index-sheet combination, said sheets of said thirty-one-index sheet combination, or said selectively-movable sheets, being provided with a coating of a selected adhesive over a restricted area thereof, said selected adhesive allowing said selectively-movable sheet to be affixed to, and to be removed from, said sheet of said thirty-one-index combination of a plurality of times.

3. The agenda system of claim 2 wherein said covers comprise: a loose leaf book which is adapted selectively to hold a plurality of sections, each of which includes an indexed sheet and a plurality of sheets.

4. The agenda system of claim 2 wherein said coating of a selected adhesive is provided by means of a double-faced adhesive tape or double-faced protected adhesive tape.

5. The agenda system of claim 2 wherein said sheets of said thirty-one-index sheet combination are coated on selected areas with a low-adhesion, pressure-sensitive adhesive and such areas are covered by a removable backing strip so that inscribed messages or appointments and/or business cards may be temporarily affixed thereto.

6. The universal agenda system of claim 2 in which each of said marginal index tabs bears the indicia both on the front face and on the rear face thereof.

7. The universal agenda system of claim 2 including a tertiary section comprising a plurality of untabbed blank or lightly printed auxiliary base sheets for use in combination with selected secondary index sheets of said thirty-one-index sheet combinations.

8. The universal agenda system of claim 2 in which each of said selectively-movable smaller inscribable sheet is provided with said coating of said selected adhesive over said restricted area thereof.

9. The universal agenda system of claim 8 wherein each of said selectively movable sheets include a minor portion coated with a low-adhesion, pressure sensitive adhesive.

* * * * *